US011297904B2

(12) United States Patent
Minami

(10) Patent No.: US 11,297,904 B2
(45) **Date of Patent: *Apr. 12, 2022**

(54) MEDIAL ROTATIONAL TRACTION ELEMENT ARRANGEMENT FOR AN ARTICLE OF FOOTWEAR

(71) Applicant: NIKE, Inc., Beaverton, OR (US)

(72) Inventor: Tetsuya T. Minami, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 256 days.

This patent is subject to a terminal disclaimer.

(21) Appl. No.: 15/254,251

(22) Filed: Sep. 1, 2016

(65) Prior Publication Data

US 2016/0366983 A1 Dec. 22, 2016

Related U.S. Application Data

(60) Continuation of application No. 14/870,737, filed on Sep. 30, 2015, which is a division of application No.
(Continued)

(51) Int. Cl.
*A43C 15/16* (2006.01)
*A43B 13/22* (2006.01)
(Continued)

(52) U.S. Cl.
CPC ..... *A43C 15/162* (2013.01); *A43B 13/223* (2013.01); *A43B 13/26* (2013.01);
(Continued)

(58) Field of Classification Search
CPC ..... A43B 5/02; A43B 13/223; A43C 15/16; A43C 15/161; A43C 15/162;
(Continued)

(56) References Cited

U.S. PATENT DOCUMENTS 365,245 A 6/1887 Graff
1,876,195 A 9/1932 Youmans
(Continued)

FOREIGN PATENT DOCUMENTS

CN 1285174 A 2/2001
DE 3127793 C1 * 1/1983 ..... A43B 3/0042
(Continued)

OTHER PUBLICATIONS

European Patent Office, Office Action for EP Application No. 16002389.1, dated Nov. 13, 2018.
(Continued)

*Primary Examiner* — Megan E Lynch
(74) *Attorney, Agent, or Firm* — Honigman LLP; Matthew H. Szalach; Jonathan O'Brien

(57) ABSTRACT

A traction element arrangement for a sole structure of an article of footwear is described. Traction elements of a first group are associated with a lateral side of the sole structure. Traction elements of a second group are associated with a medial side of the sole structure. Traction elements of the second group include multiple medial rotational traction elements that each have a plurality of individual traction elements arranged in a circular grouping. Each circular grouping is a different size to provide more or less rotational movement to the associated portion of the sole structure. In one embodiment, the shape of the traction elements corresponds to the shape of the circular grouping.

14 Claims, 7 Drawing Sheets

Related U.S. Application Data

13/234,233, filed on Sep. 16, 2011, now Pat. No. 9,173,450.

(51) Int. Cl.
*A43B 13/26* (2006.01)
*A43C 15/02* (2006.01)

(52) U.S. Cl.
CPC ..... *A43C 15/02* (2013.01); *A43C 15/16* (2013.01); *A43C 15/161* (2013.01); *A43C 15/165* (2013.01); *A43C 15/167* (2013.01)

(58) Field of Classification Search
CPC ... A43C 15/164; A43C 15/165; A43C 15/167; A43C 15/168
See application file for complete search history.

(56) References Cited

U.S. PATENT DOCUMENTS 2,261,785 A 11/1941 Youmans
D171,130 S 12/1953 Gruner
2,677,905 A 5/1954 Dye
3,040,450 A 6/1962 Phillips
3,127,687 A * 4/1964 Hollister ..... A43C 13/04 36/107
3,354,561 A 11/1967 Cameron
3,413,737 A 12/1968 Kneebusch
3,466,763 A 9/1969 Levin
3,529,370 A 9/1970 Bernier
3,583,082 A 6/1971 Jordan
3,656,245 A 4/1972 Wilson
3,680,231 A 8/1972 Dymond
3,707,047 A 12/1972 Nedwick
3,739,497 A 6/1973 Cameron
3,744,160 A 7/1973 Dymond
3,757,437 A 9/1973 Cameron
3,816,945 A 6/1974 Egtvedt
3,824,710 A 7/1974 Egtvedt
3,846,921 A 11/1974 Kobayashi
4,010,559 A 3/1977 Mitchell
4,098,011 A 7/1978 Bowerman et al.
4,233,759 A 11/1980 Bente et al.
4,241,524 A 12/1980 Sink
4,347,674 A 9/1982 George
4,392,312 A 7/1983 Crowley et al.
4,393,604 A 7/1983 Crowley
4,430,810 A 2/1984 Bente
4,472,098 A 9/1984 Kiefer
4,571,852 A 2/1986 Lamarche et al.
4,586,274 A 5/1986 Blair
D288,028 S 2/1987 Chassaing
4,660,304 A 4/1987 Tanel
4,670,997 A 6/1987 Beekman
D290,781 S 7/1987 Grubel
D290,903 S 7/1987 Inohara et al.
4,689,901 A * 9/1987 Ihlenburg ..... A43B 3/0042 36/114
D292,443 S 10/1987 Ihlenburg
D294,655 S 3/1988 Heyes
D295,231 S * 4/1988 Heyes ..... D2/954
D299,084 S 12/1988 Tanel
4,885,851 A 12/1989 Peterson
D318,170 S 7/1991 Hatfield
5,058,292 A 10/1991 Tanel
5,201,126 A 4/1993 Tanel
D342,151 S 12/1993 Saito et al.
5,335,429 A 8/1994 Hansen
D350,642 S 9/1994 Novy
5,392,537 A 2/1995 Goldberg
5,461,801 A 10/1995 Anderton
5,483,760 A 1/1996 Kataoka et al.
5,533,282 A 7/1996 Kataoka et al.
5,566,478 A 10/1996 Forrester
5,581,913 A 12/1996 Kataoka et al.
5,628,129 A 5/1997 Kilgore et al.
5,689,904 A 11/1997 Kataoka et al.
D387,892 S 12/1997 Briant
D389,294 S 1/1998 Fogg
D390,692 S 2/1998 Dietrich
5,724,754 A 3/1998 Kataoka et al.
D396,139 S 7/1998 Dietrich
5,782,017 A * 7/1998 Ortscheid ..... A43C 15/162 36/127
D397,850 S 9/1998 Harada et al.
D402,800 S 12/1998 Santos et al.
D405,249 S 2/1999 Hikita et al.
D409,362 S 5/1999 Turner et al.
5,901,472 A 5/1999 Adam
5,964,048 A 10/1999 Shieh
5,979,083 A * 11/1999 Robinson ..... A43B 1/0072 36/102
5,992,059 A * 11/1999 Bettenga ..... A43C 15/162 36/134
6,006,454 A 12/1999 Sitzler, Sr.
6,016,613 A 1/2000 Campbell et al.
6,018,893 A 2/2000 Workman
6,032,388 A 3/2000 Fram
6,035,559 A 3/2000 Freed et al.
6,041,526 A 3/2000 Collins
D422,129 S 4/2000 Garcia
D424,794 S 5/2000 Garcia
6,101,746 A * 8/2000 Evans ..... A43B 3/0042 36/128
D432,767 S 10/2000 Fogg
6,289,611 B1 * 9/2001 Patterson ..... A43B 5/001 36/127
D450,433 S 11/2001 Savoie
D454,681 S 3/2002 Duval
6,357,146 B1 3/2002 Wordsworth et al.
D455,543 S 4/2002 Feeney et al.
6,467,196 B1 10/2002 Koyama
D476,142 S 6/2003 Matis
6,647,647 B2 11/2003 Auger et al.
6,705,027 B1 3/2004 Campbell
D493,277 S 7/2004 Gan
6,793,996 B1 9/2004 Umezawa
6,892,479 B2 5/2005 Auger et al.
6,973,745 B2 12/2005 Mills et al.
7,007,410 B2 3/2006 Auger et al.
D525,416 S 7/2006 Auger et al.
D532,960 S 12/2006 Pellerin
D547,037 S 7/2007 Nakano
D552,336 S 10/2007 Parekh et al.
7,287,343 B2 10/2007 Healy
D556,985 S 12/2007 Schoenborn et al.
7,406,781 B2 8/2008 Scholz
D577,480 S 9/2008 Ortley et al.
7,430,819 B2 10/2008 Auger et al.
D580,144 S 11/2008 Lussier
7,549,239 B2 6/2009 Drollinger et al.
D595,941 S 7/2009 Byrne
7,559,160 B2 7/2009 Kelly
D605,838 S * 12/2009 Foust ..... D2/951
7,673,400 B2 3/2010 Brown et al.
7,685,745 B2 3/2010 Kuhtz et al.
D617,542 S 6/2010 Stauffer
7,730,637 B2 6/2010 Scholz
D618,895 S 7/2010 Wolff
7,757,413 B2 7/2010 Anderson
7,762,009 B2 7/2010 Gerber
7,823,301 B2 11/2010 Belluto
7,827,705 B2 11/2010 Baucom et al.
D631,237 S 1/2011 Genuin et al.
7,866,064 B2 1/2011 Gerber
7,950,168 B2 5/2011 Nakano
8,011,118 B2 9/2011 Gerber
8,079,161 B2 12/2011 Drollinger et al.
8,485,913 B2 7/2013 Antolick
8,555,528 B2 10/2013 Gerber
8,984,774 B2 3/2015 Minami
9,149,088 B2 10/2015 Minami
9,173,450 B2 * 11/2015 Minami ..... A43B 13/223
9,402,440 B2 8/2016 Diepenbrock

(56) References Cited

U.S. PATENT DOCUMENTS

| | | | | |
|---|---|---|---|---|
| D793,055 | S | 8/2017 | Woodman | |
| 9,918,519 | B2 | 3/2018 | Minami | |
| 10,278,455 | B2 | 5/2019 | Minami | |
| 10,820,661 | B2 | 11/2020 | Minami | |
| 2002/0144439 | A1 | 10/2002 | Price | |
| 2003/0192199 | A1 | 10/2003 | Nakano et al. | |
| 2004/0000071 | A1* | 1/2004 | Auger | A43B 5/02 36/59 R |
| 2004/0000075 | A1 | 1/2004 | Auger et al. | |
| 2004/0040182 | A1* | 3/2004 | McMullin | A43B 5/001 36/134 |
| 2004/0148806 | A1 | 8/2004 | Sussmann | |
| 2006/0150442 | A1 | 7/2006 | Auger et al. | |
| 2007/0062070 | A1* | 3/2007 | Kuhtz | A43B 1/0072 36/127 |
| 2007/0101618 | A1* | 5/2007 | Peake | A43B 3/0094 36/134 |
| 2007/0199211 | A1 | 8/2007 | Campbell | |
| 2007/0199213 | A1 | 8/2007 | Campbell et al. | |
| 2007/0240337 | A1 | 10/2007 | Belluto | |
| 2008/0072458 | A1 | 3/2008 | Conneally | |
| 2008/0098624 | A1 | 5/2008 | Goldman | |
| 2008/0216352 | A1 | 9/2008 | Baucom et al. | |
| 2008/0216362 | A1 | 9/2008 | Gerber | |
| 2009/0100716 | A1 | 4/2009 | Gerber | |
| 2009/0113765 | A1* | 5/2009 | Robinson, Jr | A43B 3/0078 36/127 |
| 2009/0229147 | A1 | 9/2009 | McMullin | |
| 2009/0235558 | A1 | 9/2009 | Auger et al. | |
| 2009/0249648 | A1* | 10/2009 | Brown | A43B 5/001 36/91 |
| 2009/0249652 | A1 | 10/2009 | Gunthel et al. | |
| 2009/0272012 | A1 | 11/2009 | Kelly | |
| 2009/0293317 | A1 | 12/2009 | Krikorian | |
| 2010/0064553 | A1 | 3/2010 | Savoie et al. | |
| 2010/0139129 | A1 | 6/2010 | Kuhtz et al. | |
| 2010/0154258 | A1 | 6/2010 | Scholz et al. | |
| 2010/0229427 | A1 | 9/2010 | Campbell et al. | |
| 2010/0251578 | A1 | 10/2010 | Auger et al. | |
| 2011/0023329 | A1 | 2/2011 | Auger et al. | |
| 2011/0045926 | A1 | 2/2011 | Morag et al. | |
| 2011/0047834 | A1 | 3/2011 | Baker et al. | |
| 2011/0078927 | A1 | 4/2011 | Baker | |
| 2011/0289801 | A1 | 12/2011 | Amos et al. | |
| 2014/0082968 | A1 | 3/2014 | Binzer | |
| 2015/0196088 | A1 | 7/2015 | Minami | |
| 2016/0366983 | A1 | 12/2016 | Minami | |
| 2020/0315285 | A1 | 10/2020 | Winskowicz et al. | |

FOREIGN PATENT DOCUMENTS

| | | | |
|---|---|---|---|
| DE | 3134817 | A1 | 3/1983 |
| DE | 3433070 | A1 | 3/1986 |
| DE | 3915157 | A1 | 11/1989 |
| DE | 4417563 | A1 | 11/1995 |
| EP | 0103507 | A1 | 3/1984 |
| FR | 2188416 | A5 | 1/1974 |
| GB | 706024 | A | 3/1954 |
| JP | H11276204 | A | 10/1999 |
| JP | 5503740 | B2 | 5/2014 |
| KR | 20120049228 | A | 5/2012 |
| KR | 101344667 | B1 | 12/2013 |
| WO | WO-9707700 | A2 | 3/1997 |
| WO | WO-9807343 | A1 | 2/1998 |

OTHER PUBLICATIONS

European Patent Office, Office Action for EP Application No. 16002388.3, dated Nov. 15, 2018.

State Intellectual Property Office (PRC), Office Action for CN Application No. 201610814851.9, dated Jan. 22, 2019.

European Patent Office, Extended EP Search Report for Application No. 16002389.1, dated Feb. 21, 2017.

State Intellectual Property Office (PRC), Office Action for CN Application No. 201280056455.4, dated Jul. 21, 2016.

United States Patent and Trademark Office, Final Office Action for U.S. Appl. No. 13/234,233, dated Jan. 24, 2014.

United States Patent and Trademark Office, Final Office Action for U.S. Appl. No. 13/234,233, dated Nov. 25, 2014.

International Searching Authority, International Preliminary Report on Patentability for Application No. PCT/US2012/052609, dated Mar. 27, 2014.

International Searching Authority, International Saerch Report and Written Opinion for Application No. PCT/US2012/052609, dated Jan. 24, 2013.

State Intellectual Property Office (PRC), Office Action for CN Application No. 201280056455.4, dated Apr. 28, 2015.

United States Patent and Trademark Office, Office action for U.S. Appl. No. 13/234,233, dated Sep. 6, 2013.

United States Patent and Trademark Office, Office action for U.S. Appl. No. 13/234,233, dated Jul. 16, 2014.

Staate Intellectual Property Office (PRC), Office Action for CN Application No. 201280056455.4, dated Jan. 28, 2016.

European Patent Office, Office Action for EP Application No. EO12778478.3, dated Jan. 26, 2016.

United States Patent and Trademark Office, Office Action for U.S. Appl. No. 14/870,737, dated Nov. 27, 2017.

State Intellectual Proprety Office (PRC), Office Action for CN Application No. 201610814851.9, dated May 28, 2018.

European Patent Office, Office Action for EP Application No. 16002388.3, dated Mar. 21, 2018.

European Patent Office, Office Action for EP Application No. 16002389.1, dated Mar. 21, 2018.

United Stated Patent and Trademark Office, Office Action for U.S. Appl. No. 14/870,737, dated Jun. 15, 2018.

National Intellectual Property Administration, First Office Action for CN Application No. 201710216972.8, dated Mar. 28, 2019.

China National Intellectual Property Administration, Second Office Action for CN Application No. 201710216972.8, dated Oct. 28, 2019.

* cited by examiner

MEDIAL ROTATIONAL TRACTION ELEMENT ARRANGEMENT FOR AN ARTICLE OF FOOTWEAR

CROSS-REFERENCE TO RELATED APPLICATIONS

This application is a continuing application of Minami, U.S. Patent Application Publication No. 2016/0058131, published on Mar. 3, 2016 and entitled "Medial Rotational Traction Element Arrangement for an Article of Footwear," which is a divisional application of Minami, U.S. Pat. No. 9,173,450, issued on Nov. 3, 2015 and entitled "Medial Rotational Traction Element Arrangement for an Article of Footwear," the entire disclosure of both of which are incorporated herein by reference.

BACKGROUND

The present invention relates to an article of footwear, and in particular to a medial rotational traction element arrangement for an article of footwear.

Articles of footwear having traction elements arranged in circular patterns have been previously proposed. Kuhtz et al. (U.S. Pat. No. 7,685,745) discloses a traction member for a shoe, including a group of large traction elements circumferentially-spaced about a periphery of a hub. Campbell et al. (US patent application publication number 2010/0229427) discloses a cleated athletic shoe with cushion structures, including protrusions arranged in a helical manner.

Further, articles of footwear having multiple circular patterns of traction elements have also been previously proposed. Evans (U.S. Pat. No. 6,101,746) discloses footwear including a plurality of studs disposed in concentric ring patterns. Ihlenburg (U.S. Pat. No. 4,689,901) discloses a shoe sole having toe traction arrays disposed in a generally concentric circular basis.

There exists a need in the art for a traction element arrangement that provides increased traction and mobility for an article of footwear. In particular, there exists a need in the art for a traction element arrangement that assists a wearer of an article of footwear with rotational and/or transverse movement.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
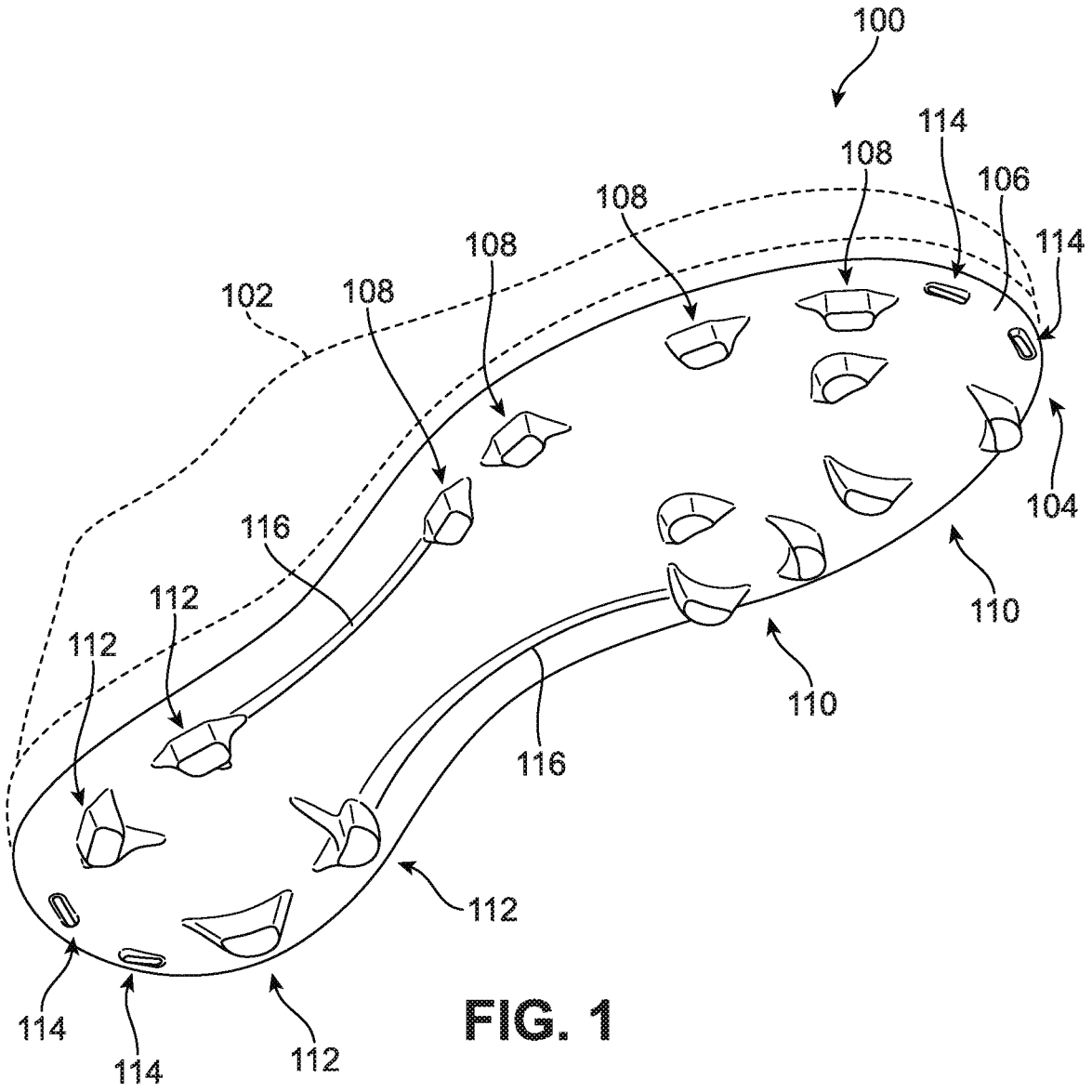
FIG. 1 is an isometric view of an article of footwear with an exemplary embodiment of a traction element arrangement.

An article of footwear with a medial rotational traction element arrangement is disclosed. In one aspect, the invention provides an article of footwear, comprising: a sole structure including a bottom surface; a first group of traction elements disposed on a lateral side of the bottom surface, the first group of traction elements including a plurality of traction elements disposed along a lateral edge of the sole structure; a second group of traction elements disposed on a medial side of the bottom surface; the second group of traction elements including a first medial rotational cleat group and a second medial rotational cleat group; the first medial rotational cleat group comprising a plurality of traction elements extending away from the bottom surface, wherein the plurality of traction elements are arranged in a first circular pattern; the second medial rotational cleat group comprising a plurality of traction elements extending away from the bottom surface, wherein the plurality of traction elements are arranged in a second circular pattern; wherein the first medial rotational cleat group is disposed adjacent a front peripheral edge of the sole structure; and wherein the second medial rotational cleat group is disposed rearward of the first medial rotational cleat group.

In another aspect, the invention provides an article of footwear, comprising: a sole structure including a bottom surface; a first medial rotational cleat group disposed on a medial side of the bottom surface; a second medial rotational cleat group disposed on the medial side of the bottom surface; the first medial rotational cleat group comprising a plurality of traction elements extending away from the bottom surface, wherein the plurality of traction elements are arranged in a first circular pattern; the second medial rotational cleat group comprising a plurality of traction elements extending away from the bottom surface, wherein the plurality of traction elements are arranged in a second circular pattern; wherein the first circular pattern is associated with a first center point and a first radius; wherein the second circular pattern is associated with a second center point different than the first center point and a second radius; and wherein the first radius is larger than the second radius.

In another aspect, the invention provides a traction element arrangement for a sole structure of an article of footwear, the traction element arrangement comprising: a first medial rotational cleat group formed on a medial side of a bottom surface of the sole structure; a second medial rotational cleat group formed on the medial side of the bottom surface of the sole structure; the first medial rotational cleat group comprising a first plurality of traction elements extending out from the bottom surface at locations disposed a first distance from a first center point; the second medial rotational cleat group comprising a second plurality of traction elements extending out from the bottom surface at locations disposed a second distance from a second center point; wherein the first distance is larger than the second distance; wherein the first center point is disposed within a forefoot region of the sole structure; and wherein the second center point is disposed on the sole structure between the first center point and a midfoot region of the sole structure.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

FIG. 1 illustrates an isometric view of an exemplary embodiment of an article of footwear 100. For clarity, the following detailed description discusses an exemplary embodiment, in the form of a soccer shoe, but it should be noted that the present invention could take the form of any article of footwear including, but not limited to: hiking boots, soccer shoes, football shoes, sneakers, rugby shoes, basketball shoes, baseball shoes as well as other kinds of shoes. As shown in FIG. 1, article of footwear 100, also referred to simply as article 100, is intended to be used with a right foot; however, it should be understood that the following discussion may equally apply to a mirror image of article of footwear 100 that is intended for use with a left foot.

In some embodiments, article 100 may include upper 102. Generally, upper 102 may be any type of upper. In particular, upper 102 may have any design, shape, size and/or color. For example, in embodiments where article 100 is a soccer shoe, upper 102 may be a low top upper. In embodiments where article 100 is a football shoe, upper 102 may be a high top upper that is shaped to provide high support on an ankle.

As shown in FIG. 1, article 100 includes sole structure 104. In some embodiments, sole structure 104 may be configured to provide traction for article 100. In addition to providing traction, sole structure 104 may attenuate ground reaction forces when compressed between the foot and the ground during walking, running or other ambulatory activities. The configuration of sole structure 104 may vary significantly in different embodiments to include a variety of conventional or non-conventional structures. Sole structure 104 extends between upper 102 and the ground when article 100 is worn. In different embodiments, sole structure 104 may include different components. For example, sole structure 104 may include an outsole, a midsole, and/or an insole. In some cases, one or more of these components may be optional.

In some embodiments, sole structure 104 may be constructed of a lightweight and flexible material. In some embodiments, sole structure 104 may be constructed of a plastic material. In an exemplary embodiment, sole structure 104 may be constructed of a plastic molding, including, but not limited to Pebax® or other thermoplastic elastomers, thermoplastic polyurethane (TPU), or carbon fiber.

In some cases, sole structure 104 may be configured according to one or more types of ground surfaces on which sole structure 104 may be used. Examples of ground surfaces include, but are not limited to: natural turf, synthetic turf, dirt, natural grass, soft natural grass, as well as other surfaces. In some embodiments, sole structure 104 may be provided with one or more types of traction elements with various arrangements on a bottom surface 106 of sole structure 104. The term "traction elements" as used in this detailed description and throughout the claims includes any provisions disposed on a sole structure for increasing traction through friction or penetration of a ground surface, including, but not limited to cleats, studs, projections, or treads. Typically, traction elements may be configured for football, soccer, baseball or any type of activity that requires traction with a ground surface.

Sole structure 104 may include one or more groups of traction elements, each group comprising a plurality of traction elements that extend away from a bottom surface 106 of sole structure 104. In an exemplary embodiment, sole structure 104 may include a first group of traction elements 108 and a second group of traction elements 110. In this embodiment, first group of traction elements 108 and second group of traction elements 110 may be different types of traction elements, discussed in more detail below. In some embodiments, sole structure 104 may include a third group of traction elements 112. In this embodiment, third group of traction elements 112 may be a different type of traction element from either or both of first group of traction elements 108 and second group of traction elements 110. In other embodiments, third group of traction elements 112 may be similar to first group of traction elements 108. In other embodiments, sole structure 104 may include any number of different or similar groups of traction elements.

Generally, traction elements may be associated with sole structure 104 in any manner. In some embodiments, traction elements may be integrally formed with sole structure 104. In other embodiments, sole structure 104 may include a partially rigid plate that extends across a substantial majority of a lower surface of sole structure 104. In some cases, traction elements may be attached to a partially rigid plate, such as by being screwed into holes within the plate or using any other provisions. Still further, in some cases, some traction elements may be integrally formed with sole structure 104, while other traction elements may be attached to and/or integrally formed with a partially rigid plate.

In some embodiments, sole structure 104 may include one or more additional components that are configured to assist with providing traction, stability, and/or support to sole structure 104 and/or article 100. In an exemplary embodiment, sole structure 104 may be provided with components that are configured to assist with providing traction to portions of sole structure 104. In this embodiment, sole structure 104 includes a plurality of peripheral studs 114. In some embodiments, plurality of peripheral studs 114 may be disposed adjacent to or near a peripheral edge of sole structure 104. In this embodiment, peripheral studs 114 may be disposed at opposite ends of sole structure 104.

In some embodiments, sole structure 104 may include one or more additional components configured to provide support and/or stability to article 100. In an exemplary embodiment, sole structure 104 may include one or more support ribs. In an exemplary embodiment, support ribs 116 may be disposed on opposite lateral and medial sides of sole structure 104 and may provide support to a midfoot and/or an arch of a foot of a wearer. In various embodiments, support ribs 116 may be made of any material configured to provide support. In an exemplary embodiment, support ribs 116 may be made of a substantially similar material as sole structure 104, described above. In other embodiments, however, one or more portions of support ribs 116 may be made of different materials, including but not limited to plastics, metal, carbon fiber or other composite materials. In addition, in some embodiments, one or more of support ribs 116 are optional and may be omitted.

Figure 2:
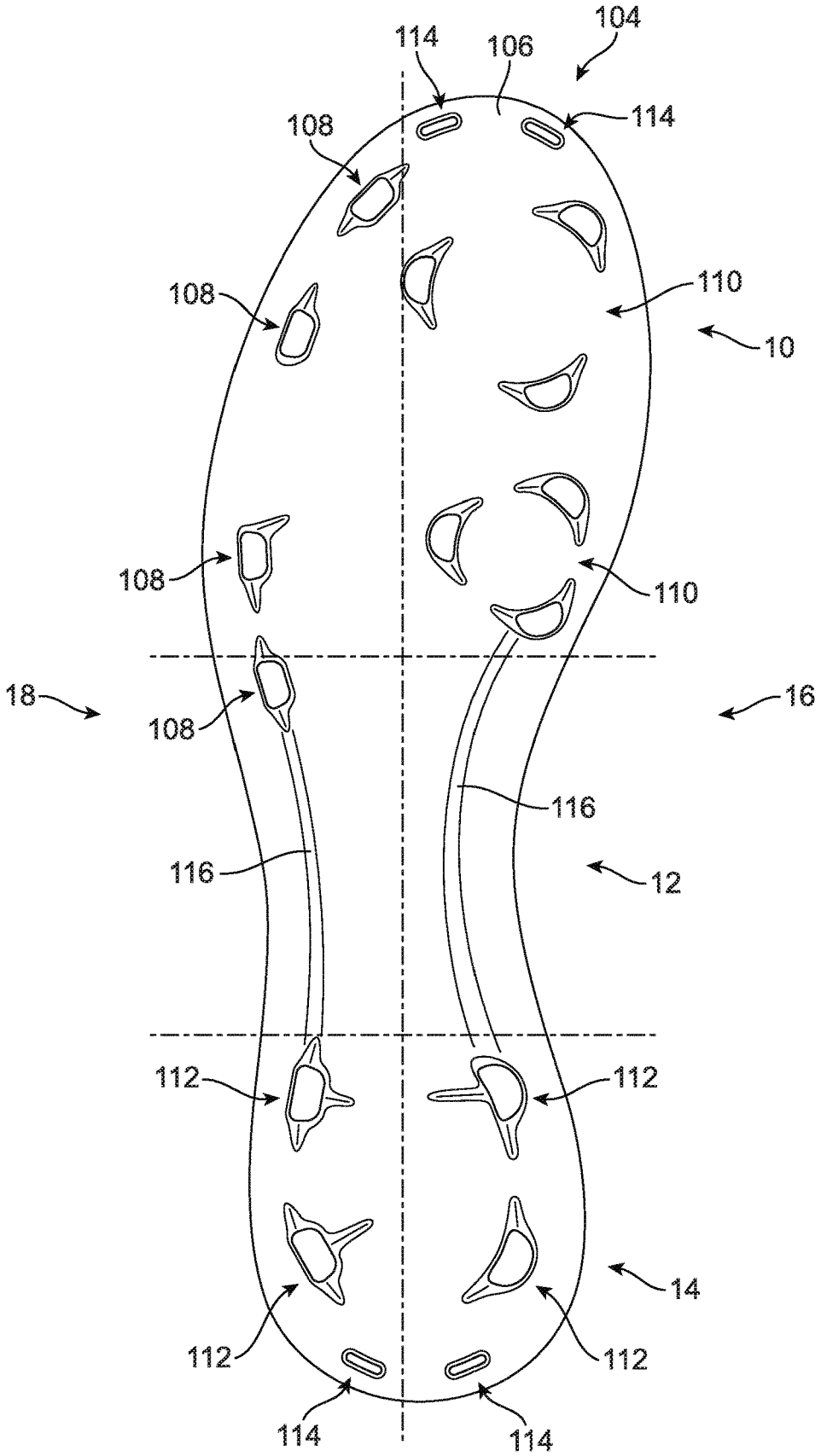
FIG. 2 is a top view of an exemplary embodiment of a traction element arrangement.

Referring to FIG. 2, for purposes of reference, article 100 may be divided into forefoot region 10, midfoot region 12, and heel region 14. Forefoot region 10 may be generally associated with the toes and joints connecting the metatarsals with the phalanges. Midfoot region 12 may be generally associated with the arch of a foot. Likewise, heel region 14 may be generally associated with the heel of a foot, including the calcaneus bone. In addition, article 100 may include medial side 16 and lateral side 18. In particular, medial side 16 and lateral side 18 may be opposing sides of article 100. Furthermore, both medial side 16 and lateral side 18 may extend through forefoot region 10, midfoot region 12, and heel region 14.

It will be understood that forefoot region 10, midfoot region 12, and heel region 14 are only intended for purposes of description and are not intended to demarcate precise regions of article 100. Likewise, medial side 16 and lateral side 18 are intended to represent generally two sides of an article, rather than precisely demarcating article 100 into two halves. In addition, forefoot region 10, midfoot region 12, and heel region 14, as well as medial side 16 and lateral side 18, can also be applied to individual components of an article, such as a sole structure and/or an upper.

For consistency and convenience, directional adjectives are employed throughout this detailed description corresponding to the illustrated embodiments. The term "longitudinal" as used throughout this detailed description and in the claims refers to a direction extending a length of an article. In some cases, the longitudinal direction may extend from a forefoot region to a heel region of the article. Also, the term "lateral" as used throughout this detailed description and in the claims refers to a direction extending a width of an article. In other words, the lateral direction may extend between a medial side and a lateral side of an article. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. It will be understood that each of these directional adjectives may be applied to individual components of an article, such as an upper and/or a sole structure.

In addition, for purposes of characterizing the size, geometry and/or orientation of a traction element, each traction element discussed in this detailed description and in the claims may be associated with a set of axes that are defined relative to each element. The term "major axis" as used throughout this detailed description and in the claims refers to an axis extending through a length of a traction element. The term "minor axis" as used throughout this detailed description and in the claims refers to an axis extending through a width of a traction element. Furthermore, the term "normal axis" as used throughout this detailed description and in the claims refers to a direction extending through a height of the traction element, which is generally perpendicular (or normal) to a plane formed between the major axis and the minor axis. It should be understood that these axes are defined locally with respect to an individual traction element so that a major axis of one traction element may not be coincident with a major axis of another traction element.

An article of footwear including a sole structure with a traction element arrangement may include provisions configured to assist with interaction between the sole structure and the ground surface. In some embodiments, the arrangement of traction elements may be configured to provide increased traction for an article of footwear. In other embodiments, a traction element arrangement may include provisions configured to assist with mobility of a wearer of an article of footwear on a ground surface. In an exemplary embodiment, a traction element arrangement may be provided to assist a wearer of an article of footwear with rotational and/or transverse movement. In other embodiments, an article may include a traction element arrangement that assists a wearer with movement in other directions.

As shown in FIG. 2, in this embodiment, first group of traction elements 108 may be disposed along lateral side 18 of sole structure 104. In one embodiment, first group of traction elements 108 may be further associated with forefoot region 10 and/or a portion of midfoot region 12. Similarly, in this embodiment, second group of traction elements 110 may be disposed generally on medial side 16 of sole structure 104. In one embodiment, second group of traction elements 110 may be further associated with forefoot region 10. In addition, in this embodiment, third group of traction elements 112 may be disposed on lateral side 18 and medial side 16 and associated with heel region 14. In other embodiments, traction elements associated with any one or more of first group of traction elements 108, second group of traction elements 110, and/or third group of traction elements 112 may disposed any one or more of lateral side 18 and medial side 16 through one or more of forefoot region 10, midfoot region 12, and heel region 14.

As shown in FIG. 2, in some embodiments, support ribs 116 may generally run longitudinally along sole structure 104 through midfoot region 12. In some embodiments, support ribs 116 may also extend into a portion of heel region 14 and/or forefoot region 10. Support ribs 116 may be configured to provide additional strength or rigidity to portions of sole structure 104. As shown in FIG. 2, sole structure 104 may include support ribs 116 disposed on medial side 16 and lateral side 18 in midfoot region 12. With this arrangement, support ribs 116 may be configured to support a midfoot and/or an arch of a wearer.

Figure 3:
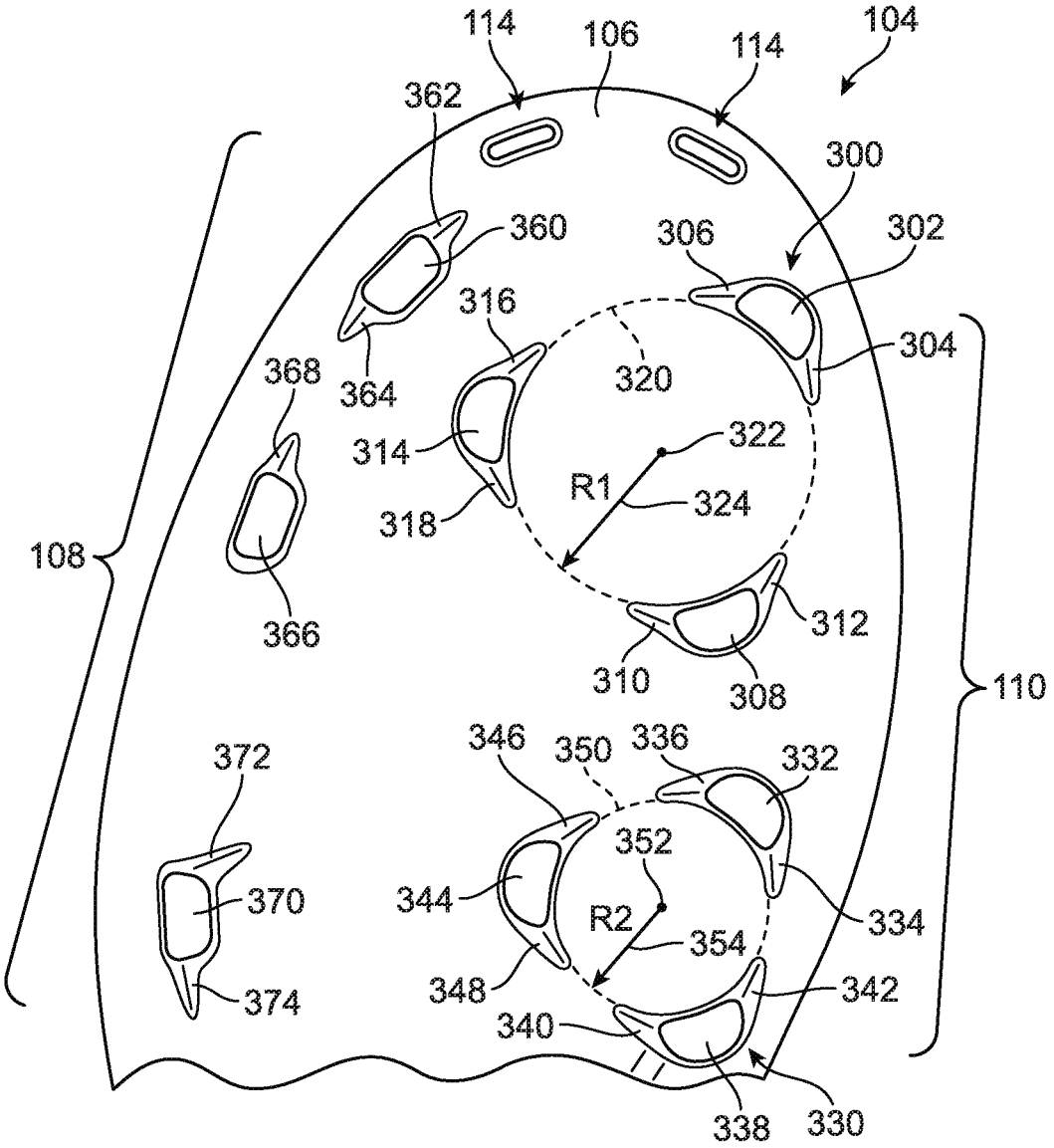
FIG. 3 is an enlarged view of a forefoot region of a sole structure including an exemplary embodiment of a traction element arrangement.

Referring now to FIG. 3, an enlarged view of forefoot region 10 including an exemplary embodiment of a traction element arrangement on sole structure 104 is illustrated. In one embodiment, the traction element arrangement on sole structure 104 may include first group of traction elements 108 and second group of traction elements 110. In this embodiment, the arrangement of first group of traction elements 108 and second group of traction elements 110 may be configured to assist a wearer of article 100 with rotational and/or transverse movement. In some embodiments, first group of traction elements 108, discussed in more detail below, may be individual cleats or studs arranged separately along lateral side 18 of sole structure 104. In an exemplary embodiment, second group of traction elements 110, discussed in more detail below, may be a group of medial rotational traction elements disposed in an approximately circular grouping of multiple cleats or studs along medial side 16 of sole structure 104. With this arrangement, the traction element arrangement on sole structure 104 may be configured to assist a wearer of article 100 with rotational and/or transverse movement.

In some embodiments, sole structure 104 may include one or more different groups of traction elements. In this embodiment, forefoot region 10 of sole structure 104 may include first group of traction elements 108 and second group of traction elements 110. In an exemplary embodiment, first group of traction elements 108 may be a different type of traction element as second group of traction elements 110. In some embodiments, different groups of traction elements may be arranged at different portions of sole structure 104. In an exemplary embodiment, first group of traction elements 108 may be arranged along lateral side 18 of forefoot region 10 of sole structure 104. In addition, in some embodiments, first group of traction elements 108 may extend further into midfoot region 12 and/or heel region 14. In one embodiment, second group of traction elements 110 may be arranged along medial side 16 of forefoot region 10 of sole structure 104.

In an exemplary embodiment, first group of traction elements 108 may be arranged adjacent to the periphery of bottom surface 106 along lateral side 18. In this embodiment, first group of traction elements 108 includes a first lateral cleat 360, a second lateral cleat 366, and a third lateral cleat 370. In an exemplary embodiment, first lateral cleat 360, second lateral cleat 366, and third lateral cleat 370 may be aligned generally along the longitudinal direction of sole structure 104. In some embodiments, the arrangement of first group of traction elements 108 may approximately follow the contour of the peripheral edge of bottom surface 106 of sole structure along lateral side 18. As shown in FIG. 3, each of first lateral cleat 360, second lateral cleat 366, and third lateral cleat 370 may be oriented with a major axis that is approximately parallel to the contour of the peripheral edge of bottom surface 106 of sole structure 104 along lateral side 18. In other embodiments, the orientation of the first group of traction elements 108 may be different. Additionally, in different embodiments, first group of traction elements 108 may include a smaller or larger number of individual traction elements.

In some embodiments, one or more of the traction elements of first group of traction elements 108 may include features to provide reinforcement to the traction elements, increase traction, and facilitate ground penetration and extraction. In some embodiments, the traction elements may be provided with one or more elongate support members extending from bottom surface 106 of sole structure 104 and abutting the side portions of the traction elements. Elongate support members may have any shape or configuration, including any of the various embodiments described in one or more of co-pending U.S. application Ser. No. 13/234,180, filed on Sep. 16, 2011, entitled "Shaped Support Features For Footwear Ground-Engaging Members," U.S. application Ser. No. 13/234,182, filed on Sep. 16, 2011, entitled "Orientations For Footwear Ground-Engaging Member Support Features," U.S. application Ser. No. 13/234,183, filed on Sep. 16, 2011, entitled "Spacing For Footwear Ground-Engaging Member Support Features," and U.S. application Ser. No. 13/234,185, filed on Sep. 16, 2011, entitled "Sole Arrangement With Ground-Engaging Member Support Features," all of these applications are hereby incorporated by reference in their entirety.

In an exemplary embodiment, first lateral cleat 360 may include elongate support members disposed on either side of first lateral cleat 360 that are generally aligned along the major axis of first lateral cleat 360. In this embodiment, first lateral cleat 360 includes a forward elongate support member 362 disposed in a direction extending towards forefoot region 10 of sole structure 104 at the front of article 100. First lateral cleat 360 also includes a rearward elongate support member 364 disposed in a direction extending towards heel region 14 of sole structure 104 at the rear of article 100.

In some embodiments, the elongate support members associated with a traction element may have a different configuration. In an exemplary embodiment, third lateral cleat 370 may include elongate support members disposed on either side of third lateral cleat 370 that have different orientations. In this embodiment, third lateral cleat 370 includes a rearward elongate support member 374 disposed in a direction extending towards heel region 14 of sole structure 104 at the rear of article 100. Third lateral cleat 370 also includes a lateral elongate support member 372 disposed in a direction generally aligned with a minor axis of third lateral cleat 370 and extending in a lateral direction across sole structure 104. With this arrangement, the elongate support members associated with third lateral cleat 370 may have different orientations. In other embodiments, each of rearward elongate support member 374 and/or lateral elongate support member 372 may have different orientations.

Further, in some embodiments, a larger or smaller number of elongate support members may be associated with a traction element. In one embodiment, a traction element may be associated with a single elongate support member. In this embodiment, second lateral cleat 366 may include a single elongate support member disposed on one side of second lateral cleat 366 that is generally aligned along the major axis of second lateral cleat 366. In this embodiment, second lateral cleat 366 includes a forward elongate support member 368 disposed in a direction extending towards forefoot region 10 of sole structure 104 at the front of article 100. In other embodiments, traction elements may have three or more elongate support members. In still other embodiments, elongate support members are optional and may be omitted.

In various embodiments, traction elements associated with first group of traction elements 108 may have different shapes. In an exemplary embodiment, traction elements in first group of traction elements 108 may have a generally curved trapezoidal shape. In this embodiment, first lateral cleat 360, second lateral cleat 366, and/or third lateral cleat 370 may have a generally curved trapezoidal shape. The generally curved trapezoidal shape may be associated with a wide face and a narrow face aligned generally parallel to the major axis, with the wide face representing the base of the trapezoid and the narrow face representing the top of the trapezoid. In other embodiments, however, first group of traction elements 108, including first lateral cleat 360, second lateral cleat 366, and/or third lateral cleat 370, may have different shapes, including but not limited to hexagonal, cylindrical, conical, circular, square, rectangular, trapezoidal, diamond, ovoid, as well as other regular or irregular and geometric or non-geometric shapes.

Referring again to FIG. 3, in an exemplary embodiment, second group of traction elements 110 may be arranged near or adjacent to the periphery of bottom surface 106 along medial side 16. In one embodiment, second group of traction elements 110 may include one or more groups of medial rotational traction elements arranged in an approximately circular grouping of a plurality of traction elements.

In this embodiment, second group of traction elements 110 includes a first medial rotational cleat group 300 and a second medial rotational cleat group 330. In some embodiments, first medial rotational cleat group 300 may include a plurality of individual traction elements arranged in a first circular pattern 320 along sole structure 104. In this embodiment, first medial rotational cleat group 300 includes a first medial cleat 302, a second medial cleat 308, and a third medial cleat 314 disposed in first circular pattern 320 on medial side 16 of sole structure 104. In this embodiment, first medial rotational cleat group 300 includes three individual traction elements arranged in circular pattern 320. In other embodiments, a group of medial rotational traction elements may include a larger or smaller number of individual traction elements.

In various embodiments, traction elements associated with second group of traction elements 110 may have different shapes. In an exemplary embodiment, traction elements associated with first medial rotational cleat group 300 and/or second medial rotational cleat group 330 may have a generally curved half-circle shape. The generally curved half-circle shape may be associated with a concave face on one side and a rounded or convex face on the opposite side. As shown in FIG. 3, each of the individual traction elements associated with first medial rotational cleat group 300 and/or second medial rotational cleat group 330 have a shape associated with a concave face oriented towards the inside of the respective circular pattern and a rounded or convex face oriented towards the outside of the respective circular pattern. With this arrangement, the traction elements associated with second group of traction elements 110 may assist a wearer when making a rotational movement with article 100. However, in other embodiments, the traction elements may have flat or curved faces oriented in a different direction or orientation and/or may have different shapes, including but not limited to hexagonal, cylindrical, conical, circular, square, rectangular, trapezoidal, diamond, ovoid, as well as other regular or irregular and geometric or non-geometric shapes.

In some embodiments, first medial rotational cleat group 300 may include individual traction elements that are located approximately a first distance 324 from a center point 322 that is associated with a first radius R1 of first circular pattern 320. In an exemplary embodiment, each of first medial cleat 302, second medial cleat 308, and third medial cleat 314 may be approximately located first distance 324 away from center point 322 to form first circular pattern 320. In some embodiments, one or more traction elements of first medial rotational cleat group 300 may be located slightly farther or closer than first distance 324 from center point 322 without substantially deviating from first circular pattern 320. In addition, it should be understood that first circular pattern 320 is only approximate and configurations of first medial rotational cleat group 300 may include other patterns that are elliptical, rather than exactly circular.

In some embodiments, second group of traction elements 110 may include second medial rotational cleat group 330. In an exemplary embodiment, second medial rotational cleat group 330 may be located near or adjacent to the periphery of bottom surface 106 along medial side 16 rearward of first medial rotational cleat group 300. In some embodiments, second medial rotational cleat group 330 may include a plurality of individual traction elements arranged in a second circular pattern 350 along sole structure 104. In this embodiment, second medial rotational cleat group 330 includes a fourth medial cleat 332, a fifth medial cleat 338, and a sixth medial cleat 334 disposed in second circular pattern 350 on medial side 16 of sole structure 104.

In an exemplary embodiment, first medial rotational cleat group 300 may be disposed closer to the front of article 100 than second medial rotational cleat group 330. In this embodiment, first medial rotational cleat group 300 is disposed within forefoot region 10 closer to a front peripheral edge of bottom surface 106. Second medial rotational cleat group 330 is disposed rearward of first medial rotational cleat group 300 such that second medial rotational cleat group 330 is within a portion of forefoot region 10 that is closer to midfoot region 12 of sole structure 104 than first medial rotational cleat group 300.

In some embodiments, second medial rotational cleat group 330 may include individual traction elements that are located approximately a second distance 354 from a center point 352 that is associated with a second radius R2 of second circular pattern 350. In an exemplary embodiment, each of fourth medial cleat 332, fifth medial cleat 338, and sixth medial cleat 334 may be approximately located second distance 354 away from center point 352 to form second circular pattern 350. In some embodiments, one or more traction elements of second medial rotational cleat group 330 may be located slightly farther or closer than second distance 354 from center point 352 without substantially deviating from second circular pattern 350. In addition, it should be understood that second circular pattern 350 is only approximate and configurations of second medial rotational cleat group 330 may include other patterns that are elliptical, rather than exactly circular.

In some embodiments, the relative of sizes of first circular pattern 320 and second circular pattern 350 may vary. In an exemplary embodiment, first medial rotational cleat group 300 may be associated with first circular pattern 320 that has first radius R1 that is larger than second radius R2 of second circular pattern 350 that is associated with second medial rotational cleat group 330. In one embodiment, the size of first radius R1 and/or second radius R2 may be configured to provide desired rotational movement in forefoot region 10 of sole structure 104. For example, in an exemplary embodiment, first radius R1 may be larger than second radius R2 to provide first medial rotational cleat group 300 with first circular pattern 320 that includes individual traction elements that are more spread apart than those associated with second medial rotational cleat group 330. With this arrangement, article 100 may be configured to have a greater degree of rotational movement at the region of sole structure 104 corresponding to first medial rotational cleat group 300. Similarly, second radius R2 may be smaller than first radius R1 to provide second medial rotational cleat group 330 with second circular pattern 350 that includes individual traction elements that are more closely spaced than those associated with first medial rotational cleat group 300. With this arrangement, article 100 may be configured to have a lesser degree of rotational movement at the region of sole structure 104 corresponding to second medial rotational cleat group 300.

In other embodiments, first circular pattern 320 and/or second circular pattern 350 may be associated with different relative sizes. In some cases, first circular pattern 320 and second circular pattern 350 may be approximately similar sizes and be associated with substantially similar radii. In other cases, second circular pattern 350 may be larger than first circular pattern 320 and, accordingly, second radius R2 may be larger than first radius R1. In addition, in other embodiments where first circular pattern 320 and/or second circular pattern 350 have other shapes, including, but not limited to elliptical shapes or shapes that slightly deviate from exactly circular, the relative sizes of first circular pattern 320 and/or second circular pattern 350 may be larger, smaller, or substantially similar to each other.

In some embodiments, first medial rotational cleat group 300 and second medial rotational cleat group 330 may be disposed on locations spaced apart on sole structure 104 such that the circular patterns of first medial rotational cleat group 300 and second medial rotational cleat group 330 do not intersect. As shown in FIG. 3, first medial rotational cleat group 300 is arranged in first circular pattern 320 that is spaced apart from second circular pattern 350 associated with second medial rotational cleat group 330. In an exemplary embodiment, first circular pattern 320 and second circular pattern 350 may be spaced apart by a separation distance than is greater than either or both of first distance 324 and second distance 354. With this arrangement, by providing a separation distance between first medial rotational cleat group 300 and second medial rotational cleat group 330 that exceeds the radii of first circular pattern 320 and/or second circular pattern 350, the respective circular patterns associated with first medial rotational cleat group 300 and second medial rotational cleat group 330 will not intersect. In other embodiments, the separation distance may vary so that a portion of first circular pattern 320 and second circular pattern 350 may intersect or overlap at one or more locations.

In some embodiments, one or more of the traction elements of second group of traction elements 110 may include features to provide reinforcement to the traction elements, increase traction, and facilitate ground penetration and extraction. In some embodiments, the traction elements may be provided with one or more elongate support members extending from bottom surface 106 of sole structure 104 and abutting the side portions of the traction elements, as discussed above. In this embodiment, first medial cleat 302 includes a leading elongate support member 304 and a trailing elongate support member 306 disposed on opposite sides of first medial cleat 302. Similarly, second medial cleat 308 includes a leading elongate support member 310 and a trailing elongate support member 312 disposed on opposite sides of second medial cleat 308, and third medial cleat 314 includes a leading elongate support member 316 and a trailing elongate support member 318 disposed on opposite sides of third medial cleat 314. In addition, in this embodiment, fourth medial cleat 332 includes a leading elongate support member 334 and a trailing elongate support member 336 disposed on opposite sides of fourth medial cleat 332. Similarly, fifth medial cleat 338 includes a leading elongate support member 340 and a trailing elongate support member 342 disposed on opposite sides of fifth medial cleat 338, and sixth medial cleat 334 includes a leading elongate support member 346 and a trailing elongate support member 348 disposed on opposite sides of sixth medial cleat 334.

Figure 4:
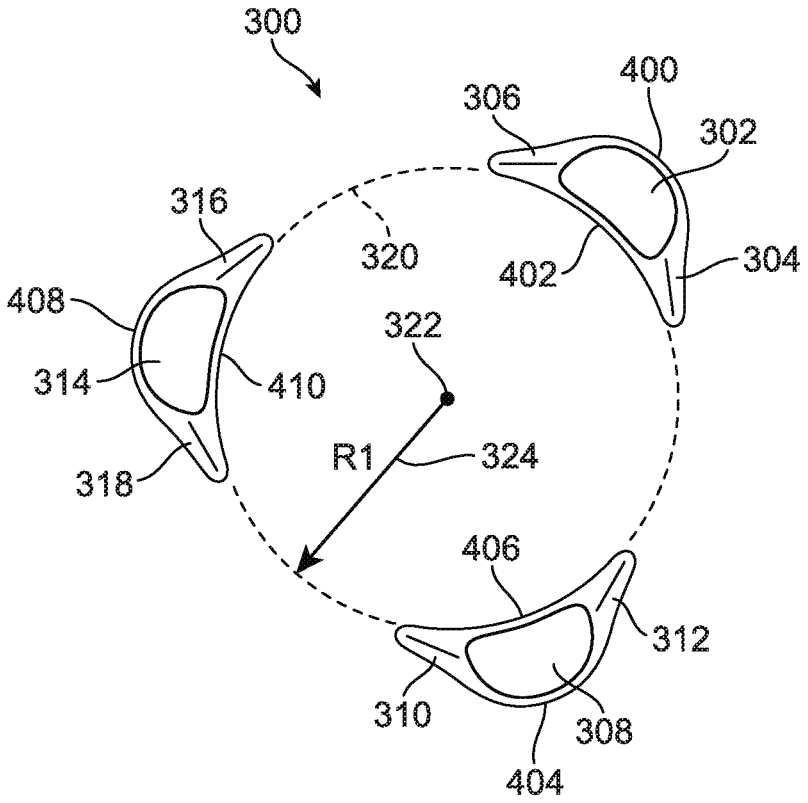
FIG. 4 is an enlarged view of an exemplary embodiment of a group of medial rotational traction elements.

Referring now to FIG. 4, an enlarged view of first medial rotational cleat group 300 is illustrated. In this embodiment, first medial cleat 302, second medial cleat 308, and third medial cleat 314 are located approximately first distance 324 away from center point 322 to form first circular pattern 320, as discussed above. In an exemplary embodiment, the shape of individual traction elements associated with first medial rotational cleat group 300 may be configured to correspond to or be coincident with circular pattern 320. In one embodiment, the shape of each individual traction element may be described in relation to a front side that faces away from circular pattern 320 and a back side that faces towards circular pattern 320. In this embodiment, first medial cleat 302 is associated with a curved semi-circular shape defined by a convex front side 400 and a concave back side 402. In this embodiment, the curvature associated with concave back side 402 of first medial cleat 302 approximately corresponds to or is coincident with circular pattern 320. Similarly, each of second medial cleat 308 and/or third medial cleat 314 includes a substantially similar shape. In this embodiment, the curved semi-circular shape of second medial cleat 308 is defined by a convex front side 404 and a concave back side 406 and the curved semi-circular shape of third medial cleat 314 is defined by a convex front side 408 and a concave back side 410.

In addition, in embodiments where traction elements include elongate support members, the elongate support members may be associated with a shape that substantially follows the contour of the circular pattern. In this embodiment, leading elongate support member 304 and trailing elongate support member 306 associated with first medial cleat 302 substantially correspond to or are coincident with circular pattern 320. Similarly, leading elongate support member 310 and trailing elongate support member 312 associated with second medial cleat 308 and leading elongate support member 316 and trailing elongate support member 318 associated with third medial cleat 314 may also substantially correspond to or are coincident with circular pattern 320. In addition, in other embodiments where the circular pattern has other shapes, including, but not limited to elliptical shapes or shapes that slightly deviate from exactly circular, the shapes of traction elements and/or associated elongate support members may substantially correspond to or be coincident with these other shapes.

It should be understood that individual traction elements and/or elongate support members associated with second medial rotational cleat group 330 may be configured with shapes that have a substantially similar arrangement as those associated with first medial rotation cleat group 300, described above.

Figure 5:
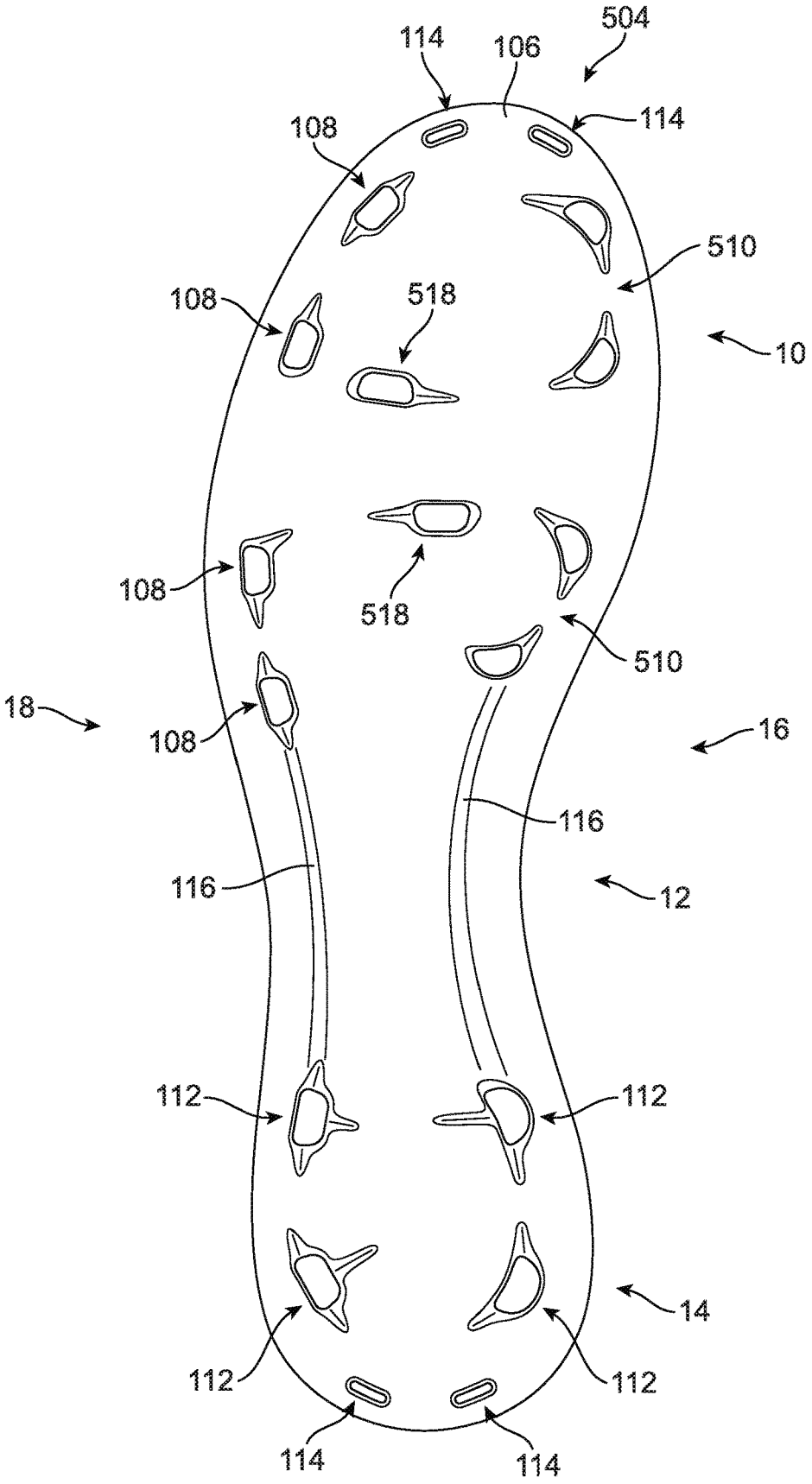
FIG. 5 is a top view of an alternate embodiment of a traction element arrangement.
Figure 6:
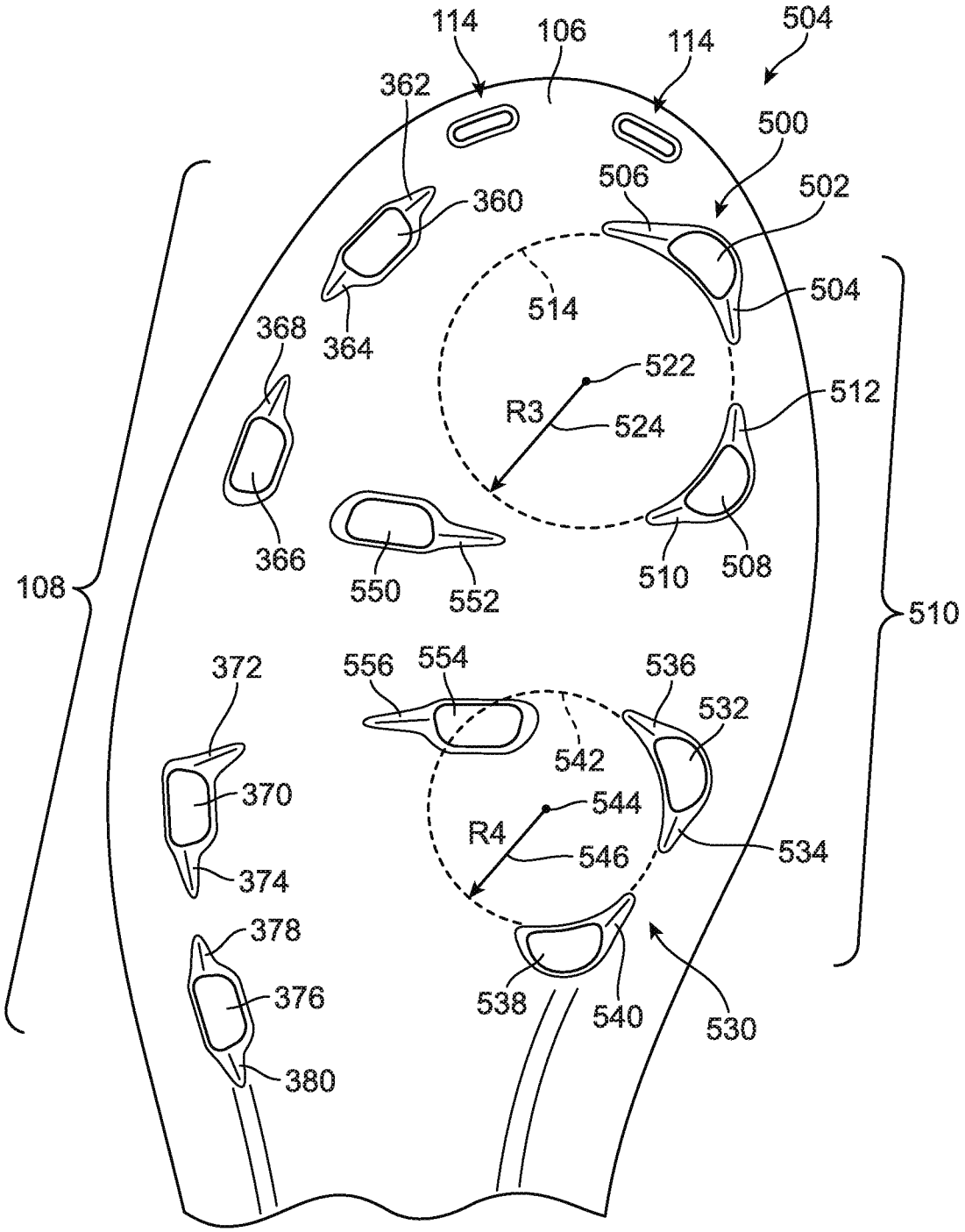
FIG. 6 is an enlarged view of an alternate embodiment of a group of medial rotational traction elements.

In some embodiments, the shape, configuration and/or arrangement of groups of traction elements on a sole structure may vary. Referring now to FIGS. 5 and 6, an alternate embodiment of a traction element arrangement for a sole structure 504 of article 100 is illustrated. In some embodiments, sole structure 504 may be substantially similar to sole structure 104, including one or more components as described above in regard to sole structure 104. Referring now to FIG. 5, in an exemplary embodiment, sole structure 504 may include first group of traction elements 108 and/or third group of traction elements 112, as described above, disposed on bottom surface 106 of sole structure 504. In addition, sole structure 504 may further include plurality of peripheral studs 114 and/or support ribs 116, as described above.

In some embodiments, sole structure 504 may include an alternate configuration for second group of traction elements 110. In an exemplary embodiment, sole structure 504 includes a second group of traction elements 510, discussed in more detail below. In one embodiment, second group of traction elements 510 may be one or more groups of medial rotational traction elements disposed in an approximately circular grouping of multiple cleats or studs along medial side 16 of sole structure 504. In this embodiment, second group of traction elements 510 includes groups of medial rotational traction elements disposed in an approximately circular grouping of two cleats or studs. In contrast, second group of traction elements 110, as described in the embodiments above, includes groups of medial rotational traction elements disposed in an approximately circular grouping of three cleats or studs. It should be understood that in other embodiments, groups of medial rotational traction elements may include different numbers of cleats or studs disposed in an approximately circular grouping. With this arrangement, the traction element arrangement on sole structure 504 may be configured to assist a wearer of article 100 with rotational and/or transverse movement.

In some embodiments, sole structure 504 may include one or more secondary stud members 518. In an exemplary embodiment, one or more secondary stud members 518 may be disposed adjacent to one or more of the traction elements of first group of traction elements 108 and/or second group of traction elements 510. In one embodiment, secondary stud members 518 may be disposed approximately in the middle of sole structure 504 between lateral side 18 and medial side 16. With this arrangement, secondary stud members 518 may be configured to provide support to a portion of sole structure 504 between first group of traction elements 108 disposed along lateral side 18 and second group of traction elements 510 disposed along medial side 16.

In this embodiment, secondary stud members 518 are disposed adjacent to traction elements associated with first group of traction elements 108 and second group of traction elements 510. In an exemplary embodiment, secondary stud members 518 may be oriented in a generally lateral direction across sole structure 504. With this arrangement, secondary stud members 518 may assist with providing stability to article 100. In other embodiments, secondary stud members 518 may have a different orientation.

In some cases, secondary stud members 518 may be separate from the traction elements associated with first group of traction elements 108 and/or second group of traction elements 510. In other cases, however, secondary stud members 518 may be connected to other traction elements. In addition, in some embodiments, secondary stud members 518 are optional and may be omitted.

Referring now to FIG. 6, an enlarged view of forefoot region 10 including an alternate embodiment of a traction element arrangement on sole structure 504 is illustrated. In one embodiment, the traction element arrangement on sole structure 504 may include first group of traction elements 108, as described above, and second group of traction elements 510. In this embodiment, the arrangement of first group of traction elements 108 and second group of traction elements 510 may be configured to assist a wearer of article 100 with rotational and/or transverse movement. In an exemplary embodiment, first group of traction elements 108 may be arranged adjacent to the periphery of bottom surface 106 along lateral side 18, as discussed above. In this embodiment, first group of traction elements 108 includes first lateral cleat 360, second lateral cleat 366, and third lateral cleat 370, as discussed above. In addition, in this embodiment, first group of traction elements 108 also includes a fourth lateral cleat 376.

Further, in this embodiment, each traction element of first group of traction elements 108 includes at least one elongate support member, as described above. First lateral cleat 360 includes forward elongate support member 362 disposed in a direction extending towards forefoot region 10 of sole structure 504 at the front of article 100 and rearward elongate support member 364 disposed in a direction extending towards heel region 14 of sole structure 504 at the rear of article 100. In this embodiment, second lateral cleat 366 includes forward elongate support member 368 disposed in a direction extending towards forefoot region 10 of sole structure 504 at the front of article 100. Third lateral cleat 370 includes rearward elongate support member 374 disposed in a direction extending towards heel region 14 of sole structure 504 at the rear of article 100 and lateral elongate support member 372 disposed in a direction generally aligned with a minor axis of third lateral cleat 370 and extending in a lateral direction across sole structure 504. In addition, in this embodiment, fourth lateral cleat 376 includes a forward elongate support member 378 disposed in a direction extending towards forefoot region 10 of sole structure 504 at the front of article 100 and a rearward elongate support member 380 disposed in a direction extending towards heel region 14 of sole structure 504 at the rear of article 100. As described above, in other embodiments, different arrangements of elongate support members may be provided. In still other embodiments, elongate support members are optional and may be omitted.

In an exemplary embodiment, second group of traction elements 510 may be arranged near or adjacent to the periphery of bottom surface 106 along medial side 16. In one embodiment, second group of traction elements 510 may include one or more groups of medial rotational traction elements arranged in an approximately circular grouping of a plurality of traction elements. In this embodiment, each circular grouping includes two individual traction elements.

In this embodiment, second group of traction elements 510 includes a first medial rotational cleat group 500 and a second medial rotational cleat group 530. In some embodiments, first medial rotational cleat group 500 may include a plurality of individual traction elements arranged in a first circular pattern 520 along sole structure 504. In this embodiment, first medial rotational cleat group 500 includes a first medial cleat 502 and a second medial cleat 508 disposed in first circular pattern 514 on medial side 16 of sole structure 504. In this embodiment, first medial rotational cleat group 500 includes two individual traction elements arranged in circular pattern 514. In other embodiments, a group of medial rotational traction elements may include a larger number of individual traction elements.

In various embodiments, traction elements associated with second group of traction elements 510 may have different shapes, as described above in regard to second group of traction elements 110. In an exemplary embodiment, traction elements associated with first medial rotational cleat group 500 and/or second medial rotational cleat group 530 may have a generally curved half-circle shape. The generally curved half-circle shape may be associated with a concave face on one side and a rounded or convex face on the opposite side.

As shown in FIG. 6, each of the individual traction elements associated with first medial rotational cleat group 500 and/or second medial rotational cleat group 530 have a shape associated with a concave face oriented towards the inside of the respective circular pattern and a rounded or convex face oriented towards the outside of the respective circular pattern. With this arrangement, the traction elements associated with second group of traction elements 510 may assist a wearer when making a rotational movement with article 100. However, in other embodiments, the traction elements may have flat or curved faces oriented in a different direction or orientation and/or may have different shapes, including but not limited to hexagonal, cylindrical, conical, circular, square, rectangular, trapezoidal, diamond, ovoid, as well as other regular or irregular and geometric or non-geometric shapes.

In some embodiments, first medial rotational cleat group 500 may include individual traction elements that are located approximately a third distance 524 from a center point 522 that is associated with a third radius R3 of first circular pattern 514. In an exemplary embodiment, each of first medial cleat 502 and second medial cleat 508 may be approximately located third distance 524 away from center point 522 to form first circular pattern 514. In some embodiments, one or more traction elements of first medial rotational cleat group 500 may be located slightly farther or closer than first distance 524 from center point 522 without substantially deviating from first circular pattern 514. In addition, it should be understood that first circular pattern 514 is only approximate and configurations of first medial rotational cleat group 500 may include other patterns that are elliptical, rather than exactly circular.

In some embodiments, second group of traction elements 510 may include second medial rotational cleat group 530. In an exemplary embodiment, second medial rotational cleat group 530 may be located near or adjacent to the periphery of bottom surface 106 along medial side 16 rearward of first medial rotational cleat group 500. In some embodiments, second medial rotational cleat group 530 may include a plurality of individual traction elements arranged in a second circular pattern 542 along sole structure 504. In this embodiment, second medial rotational cleat group 530 includes a third medial cleat 532 and a fourth medial cleat 538 disposed in second circular pattern 542 on medial side 16 of sole structure 504.

In an exemplary embodiment, first medial rotational cleat group 500 may be disposed closer to the front of article 100 than second medial rotational cleat group 530. In this embodiment, first medial rotational cleat group 500 is disposed within forefoot region 10 closer to a front peripheral edge of bottom surface 106. Second medial rotational cleat group 530 is disposed rearward of first medial rotational cleat group 500 such that second medial rotational cleat group 530 is within a portion of forefoot region 10 that is closer to midfoot region 12 of sole structure 504 than first medial rotational cleat group 500.

In some embodiments, second medial rotational cleat group 530 may include individual traction elements that are located approximately a fourth distance 546 from a center point 544 that is associated with a fourth radius R4 of second circular pattern 542. In an exemplary embodiment, each of third medial cleat 532 and fourth medial cleat 538 may be approximately located fourth distance 546 away from center point 544 to form second circular pattern 542. In some embodiments, one or more traction elements of second medial rotational cleat group 530 may be located slightly farther or closer than fourth distance 546 from center point 544 without substantially deviating from second circular pattern 542. In addition, it should be understood that second circular pattern 542 is only approximate and configurations of second medial rotational cleat group 530 may include other patterns that are elliptical, rather than exactly circular.

In some embodiments, the relative of sizes of first circular pattern 514 and second circular pattern 542 may vary, as described above in regard to first circular pattern 320 and second circular pattern 350. In an exemplary embodiment, first medial rotational cleat group 500 may be associated with first circular pattern 514 that has third radius R3 that is larger than fourth radius R4 of second circular pattern 542 that is associated with second medial rotational cleat group 530.

In some embodiments, one or more of the traction elements of second group of traction elements 510 may include features to provide reinforcement to the traction elements, increase traction, and facilitate ground penetration and extraction. In some embodiments, the traction elements may be provided with one or more elongate support members extending from bottom surface 106 of sole structure 504 and abutting the side portions of the traction elements, as discussed above. In this embodiment, first medial cleat 502 includes a leading elongate support member 504 and a trailing elongate support member 506 disposed on opposite sides of first medial cleat 502. Similarly, second medial cleat 508 includes a leading elongate support member 510 and a trailing elongate support member 512 disposed on opposite sides of second medial cleat 508.

In this embodiment, where second group of traction elements 510 includes groups of medial rotational traction elements with two individual traction elements, one or more of the elongate support members may be extended to provide additional traction. In this embodiment, trailing elongate support member 506 associated with first medial cleat 502 may be extended such that it is longer than leading elongate support member 504 disposed on the opposite side of first medial cleat 502.

In addition, in this embodiment, third medial cleat 532 includes a leading elongate support member 534 and a trailing elongate support member 536 disposed on opposite sides of third medial cleat 532. Fourth medial cleat 538 includes a trailing elongate support member 540 disposed on one side of fourth medial cleat 538. In this embodiment, fourth medial cleat 538 does not include an elongate support member disposed on the opposite side. In other embodiments, however, a larger or smaller number of elongate support members may be provided. In still other embodiments, elongate support members are optional and may be omitted.

In some embodiments, sole structure 504 may include one or more secondary stud members 518, as described above. In an exemplary embodiment, secondary stud members 518 may include a first secondary stud 550 and a second secondary stud 554. In some embodiments, first secondary stud 550 and/or second secondary stud 554 may be disposed adjacent to one or more of the traction elements of first group of traction elements 108 and/or second group of traction elements 510. In one embodiment, first secondary stud 550 and second secondary stud 554 are disposed approximately in the middle of sole structure 504 between lateral side 18 and medial side 16. In an exemplary embodiment, first secondary stud 550 and second secondary stud 554 may be arranged in an offset configuration with one secondary stud closer to one of lateral side 18 or medial side 16 than the other. In this embodiment, first secondary stud 550 is disposed closer to second lateral cleat 366 on lateral side 18 and second secondary stud 554 is disposed closer to third medial cleat 532 on medial side 16. With this offset arrangement, first secondary stud 550 and second secondary stud 554 may be configured to provide support to a portion of sole structure 504 between first group of traction elements 108 disposed along lateral side 18 and second group of traction elements 510 disposed along medial side 16.

In addition, in this embodiment, each of first secondary stud 550 and second secondary stud 554 includes elongate support members disposed on one side of the secondary stud member. In an exemplary embodiment, each secondary stud may be configured with an elongate support member disposed on a side opposite the side to which the secondary stud member is offset. For example, in the current embodiment, first secondary stud 550 is offset to lateral side 18 closer to second lateral cleat 366. Accordingly, first secondary stud 550 may include a first lateral elongate support member 552 that is disposed on the side of first secondary stud 550 facing towards medial side 16. Similarly, secondary stud 554 is offset to medial side 16 closer to third medial cleat 532. Accordingly, second secondary stud 554 may include a second lateral elongate support member 556 that is disposed on the side of second secondary stud 554 facing towards lateral side 18. In other embodiments, a larger or smaller number of elongate support members may be disposed on various sides of the secondary stud members. In still other embodiments, elongate support members are optional and may be omitted.

In some embodiments, second secondary stud 554 may be disposed on sole structure 504 at a location so as to intersect second circular pattern 542. With this arrangement, second secondary stud 554 may provide additional support and/or stability to second medial rotational cleat group 530. In other embodiments, however, second secondary stud 554 may be disposed on sole structure 504 at a location so as to be outside of second circular pattern 542. For example, in one embodiment, second secondary stud 554 may be located forward along sole structure 504 in a direction towards forefoot region 10 so that second secondary stud 554 may be located closer to first secondary stud 550. With this arrangement, second secondary stud 554 may be located outside of second circular pattern 542.

In addition to the traction element configurations for sole structure 104 and/or sole structure 504 described in the present embodiments, one or more traction elements may be arranged with configurations and/or features from any of the various embodiments described in co-pending U.S. application Ser. No. 13/234,168, filed on Sep. 16, 2011, entitled "Medial Rotational Traction Element Arrangement for an Article of Footwear," which application is hereby incorporated by reference in its entirety.

In some embodiments, additional features may be added to a sole structure to assist article 100 with interacting with a ground surface. In some cases, additional features may assist with one or more of ground penetration, traction on portions of a sole structure not provided with traction elements, traction on different types of ground surfaces, as well as assisting with transverse and/or rotational movement. In an exemplary embodiment, sole structure 104 may be provided with components that are configured to assist with providing traction to portions of sole structure 104. In this embodiment, sole structure 104 includes a plurality of peripheral studs 114. In some embodiments, plurality of peripheral studs 114 may be disposed adjacent to or near a peripheral edge of sole structure 104. In this embodiment, peripheral studs 114 may be disposed at opposite ends of sole structure 104, including adjacent to a top peripheral edge of forefoot region 10 and/or adjacent to a bottom peripheral edge of heel region 14.

Figure 7:
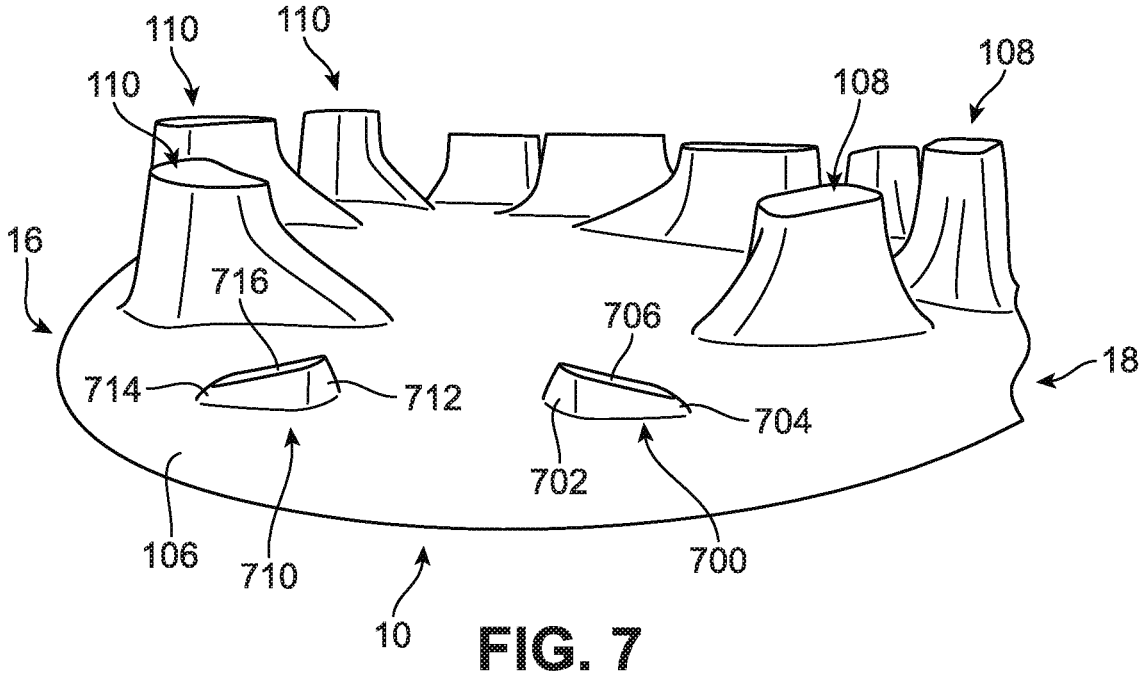
FIG. 7 is an enlarged isometric view of a forefoot region of a sole structure including peripheral studs.
Figure 8:
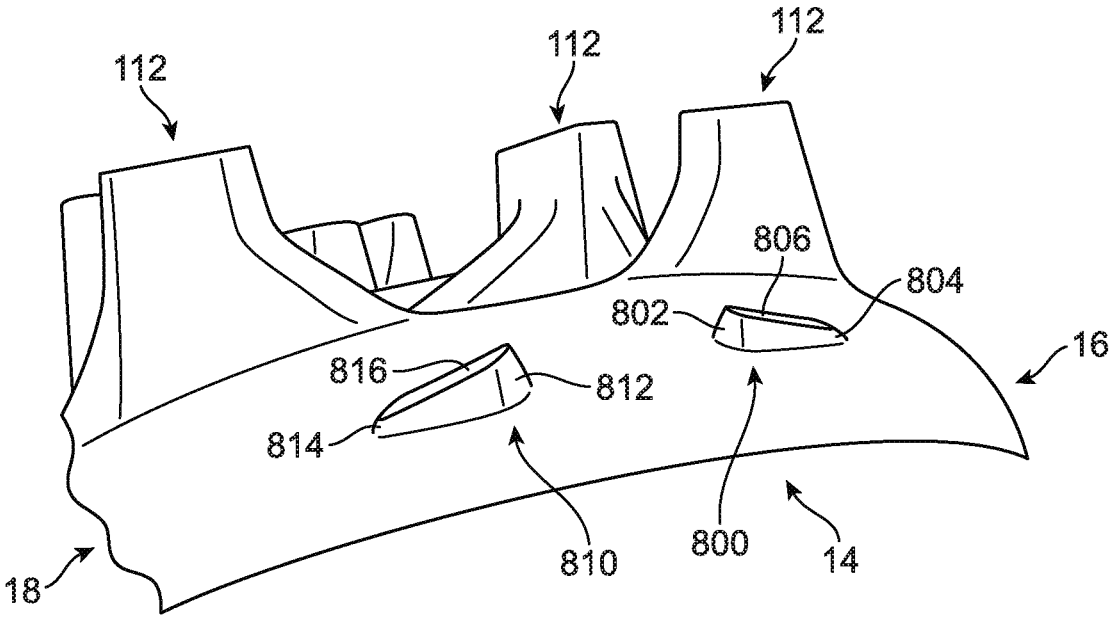
FIG. 8 is an enlarged isometric view of a heel region of a sole structure including peripheral studs.

FIGS. 7 and 8 illustrate different embodiments of plurality of peripheral studs 114 that may be provided on a sole structure adjacent i a top peripheral edge of forefoot region 10 and/or a bottom peripheral edge of heel region 14 to assist with providing traction with a ground surface. Referring now to FIG. 7, an exemplary embodiment of peripheral studs 114 disposed adjacent to the top peripheral edge of forefoot region 10 of sole structure 104 is illustrated. In this embodiment, peripheral studs 114 include a first toe stud 700 and a second toe stud 710. In some embodiments, first toe stud 700 and/or second toe stud 710 may be raised projections that extend out from bottom surface 106 of sole structure 104.

In an exemplary embodiment, first toe stud 700 and second toe stud 710 may be disposed on opposite sides of sole structure 104. In this embodiment, first toe stud 700 may be disposed on lateral side 18 of sole structure 104 and second toe stud 710 may be disposed on medial side 16 of sole structure 104. In an exemplary embodiment, the major axis of first toe stud 700 and/or second toe stud 710 may be aligned in a generally lateral direction across sole structure 104. In some embodiments, first toe stud 700 and/or second toe stud 710 may be configured so that a ground-engaging face slopes away from the middle of sole structure 104 towards either side. In this embodiment, first toe stud 700 includes a raised end 702 that extends above bottom surface 106 of sole structure 104 and a tapered end 704 that is approximately even with bottom surface 106 of sole structure 104. Ground-engaging face 706 of first toe stud 700 may slope from raised end 702 towards tapered end 704 in a direction of lateral side 18.

Similarly, in this embodiment, second toe stud 710 includes a raised end 712 that extends above bottom surface 106 of sole structure 104 and a tapered end 714 that is approximately even with bottom surface 106 of sole structure 104. Ground-engaging face 716 of second toe stud 710 may slope from raised end 712 towards tapered end 714 in a direction of medial side 16. With this arrangement, first toe stud 700 and/or second toe stud 710 may provide additional traction to a toe portion of forefoot region 10.

Referring now to FIG. 8, an exemplary embodiment of peripheral studs 114 disposed adjacent to the bottom peripheral edge of heel region 14 of sole structure 104 is illustrated. Peripheral studs 114 disposed adjacent to the bottom peripheral edge of heel portion 14 may be substantially similar to the peripheral studs 114 disposed at the toe portion of forefoot region 10, described above. In this embodiment, peripheral studs 114 include a first heel stud 800 and a second heel stud 810. In some embodiments, first heel stud 800 and/or second heel stud 810 may be raised projections that extend out from bottom surface 106 of sole structure 104.

In an exemplary embodiment, first heel stud 800 and second heel stud 810 may be disposed on opposite sides of sole structure 104. In this embodiment, first heel stud 800 may be disposed on lateral side 18 of sole structure 104 and second heel stud 810 may be disposed on medial side 16 of sole structure 104. In an exemplary embodiment, the major axis of first heel stud 800 and/or second heel stud 810 may be aligned in a generally lateral direction across sole structure 104. In some embodiments, first heel stud 800 and/or second heel stud 810 may be configured so that a ground-engaging face slopes away from the middle of sole structure 104 towards either side. In this embodiment, first heel stud 800 includes a raised end 802 that extends above bottom surface 106 of sole structure 104 and a tapered end 804 that is approximately even with bottom surface 106 of sole structure 104. Ground-engaging face 806 of first heel stud 800 may slope from raised end 802 towards tapered end 804 in a direction of lateral side 18.

Similarly, in this embodiment, second heel stud 810 includes a raised end 812 that extends above bottom surface 106 of sole structure 104 and a tapered end 814 that is approximately even with bottom surface 106 of sole structure 104. Ground-engaging face 816 of second heel stud 810 may slope from raised end 812 towards tapered end 814 in a direction of medial side 16. With this arrangement, first heel stud 800 and/or second heel stud 810 may provide additional traction to a rear portion of heel region 14.

In an exemplary embodiment, the height of peripheral studs 114, including first toe stud 700, second toe stud 710, first heel stud 800, and/or second heel stud 810, may vary. In some cases, peripheral studs 114 may extend from 0.25 mm to 1.5 mm above the bottom surface of the sole structure 104 and/or sole structure 504. In other cases, peripheral studs 114 may be smaller or larger. In addition, in some embodiments, peripheral studs 114 are optional and may be omitted.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. An article of footwear, comprising:

a sole structure including a bottom surface;

a first cleat group disposed in a forefoot region of the sole structure and including a plurality of first traction elements integrally molded with the sole structure and extending away from the bottom surface, the plurality of first traction elements being arranged a first distance from a first common center point in a circular pattern and having two first traction elements of the plurality of first traction elements disposed proximate to one of a medial edge of the sole structure and a lateral edge of the sole structure;

a second cleat group disposed in the forefoot region of the sole structure and including a plurality of second traction elements each having a different shape than the first traction elements of the plurality of first traction elements and being disposed proximate to the other of the medial edge and the lateral edge, at least one second traction element of the plurality of second traction elements being disposed closer to a heel region of the sole structure than at least one first traction element of the plurality of first traction elements;

wherein each first traction element of the plurality of first traction elements includes a concave inner face and a convex outer face disposed opposite the concave inner face, the concave inner face facing towards the circular pattern and substantially following a contour of the circular pattern;

wherein each first traction element of the plurality of first traction elements includes a junction where each first traction element of the plurality of first traction elements joins with the bottom surface, the junction of each first traction element of the plurality of first traction elements being spaced apart from the junction of an adjacent first traction element of the plurality of first traction elements by an expanse of the bottom surface; and wherein the concave inner face and the convex outer face of each first traction element of the plurality of first traction elements extends from a first end of the first traction element to a second end of the first traction element, the concave inner face of each first traction element having a continuous and uninterrupted constant radius from the first end to the second end of the first traction element.

2. The article of footwear according to claim 1, wherein each first traction element of the plurality of first traction elements includes a ground-engaging face that is substantially parallel with the bottom surface of the sole structure.

3. The article of footwear according to claim 2, wherein each first traction element of the plurality of first traction elements tapers from the junction to the ground-engaging face.

4. The article of footwear according to claim 1, wherein the bottom surface is devoid of the first traction elements and the second traction elements in a space between the plurality of first traction elements and the first common center point.

5. The article of footwear according to claim 1, wherein each first traction element of the plurality of first traction elements has a width defined between the concave inner face and the convex outer face and wherein the width of each first traction element of the plurality of first traction elements is larger at a center of each first traction element than at the first end or the second end of each first traction element.

6. The article of footwear according to claim 1, wherein at least one of the second traction elements of the plurality of second traction elements includes an arcuate outer surface opposing the other of the medial edge and the lateral edge.

7. The article of footwear according to claim 1, further comprising a third traction element (i) having the shape of the first traction elements of the plurality of first traction elements, (ii) being disposed closer to a heel region of the sole structure than any of the first traction elements of the plurality of first traction elements and any of the second traction elements of the plurality of second traction elements, and (iii) being disposed in the forefoot region.

8. An article of footwear, comprising:

a sole structure including a bottom surface;

a first cleat group disposed in a forefoot region of the sole structure and including a plurality of first traction elements integrally molded with the sole structure and extending away from the bottom surface, the plurality of first traction elements being arranged in a first circular pattern with a first common center point and having two first traction elements of the plurality of first traction elements disposed closer to one of a medial edge of the sole structure and a lateral edge of the sole structure;

a second cleat group disposed in the forefoot region of the sole structure and including a plurality of second traction elements having a different shape than the first traction elements of the plurality of first traction elements, the plurality of second traction elements disposed proximate to the other of the medial edge and the lateral edge; and a third traction element (i) having the shape of the first traction elements of the plurality of first traction elements, (ii) being disposed closer to a heel region of the sole structure than any of the first traction elements of the plurality of first traction elements and any of the second traction elements of the plurality of second traction elements, and (iii) being disposed in the forefoot region, wherein each first traction element of the plurality of first traction elements includes a concave inner face facing towards the first circular pattern that substantially follows a contour of the first circular patter, the concave inner face having a continuous and uninterrupted constant radius from a first end of the first traction element to a second end of the first traction element.

9. The article of footwear according to claim 8, wherein each first traction element of the plurality of first traction elements includes a ground-engaging face that is substantially parallel with the bottom surface.

10. The article of footwear according to claim 9, wherein each first traction element of the plurality of first traction elements tapers from a junction of each first traction element and the bottom surface to the ground-engaging face.

11. The article of footwear according to claim 8, wherein each first traction element of the plurality of first traction elements includes a convex outer face disposed opposite the concave inner face.

12. The article of footwear according to claim 11, wherein the convex outer face of at least one first traction element of the plurality of first traction elements opposes the one of the medial edge of the sole structure and the lateral edge of the sole structure.

13. The article of footwear according to claim 11, wherein the third traction element includes a concave surface opposing at least one of the plurality of first traction elements and the plurality of second traction elements.

14. The article of footwear according to claim 13, wherein the third traction element includes a convex surface opposing the heel region of the sole structure.

* * * * *